US009585450B2

(12) United States Patent
Peck et al.

(10) Patent No.: US 9,585,450 B2
(45) Date of Patent: Mar. 7, 2017

(54) CONTACT LENS PACKAGES

(75) Inventors: James M. Peck, Jacksonville, FL (US); George E. Himes, Jr., Jacksonville, FL (US); Michael G. Tokarski, Ponte Vedra Beach, FL (US); Christopher Wildsmith, Jacksonville, FL (US); David C. Turner, Jacksonville, FL (US); John B. Fore, Travelers Rest, SC (US); Mark Mandeville, Candler, NC (US)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 883 days.

(21) Appl. No.: 13/540,086

(22) Filed: Jul. 2, 2012

(65) Prior Publication Data

US 2012/0267808 A1 Oct. 25, 2012

Related U.S. Application Data

(63) Continuation of application No. 12/897,005, filed on Oct. 4, 2010, now abandoned, which is a continuation of application No. 11/937,780, filed on Nov. 9, 2007, now abandoned, which is a continuation of application No. 10/458,439, filed on Jun. 10, 2003, now abandoned, which is a continuation-in-part of application No. 10/183,133, filed on Jun. 26, 2002, now abandoned.

(51) Int. Cl.

| | |
|---|---|
| ***A45C 11/00*** | (2006.01) |
| ***A45C 11/04*** | (2006.01) |
| ***B65D 75/36*** | (2006.01) |

(52) U.S. Cl.

CPC ..... *A45C 11/005* (2013.01); *A45C 11/046* (2013.01); *B65D 75/36* (2013.01); *B65D 2585/545* (2013.01)

(58) Field of Classification Search

CPC ..... A45C 11/005; A45C 11/046; B65D 2585/545

USPC ..... 53/431; 206/5, 5.1, 205, 765; 264/2.6

See application file for complete search history.

(56) References Cited

U.S. PATENT DOCUMENTS

| | | | | |
|---|---|---|---|---|
| 3,279,482 | A * | 10/1966 | Hungerford et al. | 134/145 |
| 3,394,717 | A * | 7/1968 | Hollinger | 134/137 |
| 4,129,211 | A | 12/1978 | Clement et al. | |
| 4,691,820 | A | 9/1987 | Martinez | |
| 4,858,754 | A | 8/1989 | Wright et al. | |
| 4,942,959 | A | 7/1990 | Sauber et al. | |
| 5,054,610 | A | 10/1991 | Ajello | |

(Continued)

FOREIGN PATENT DOCUMENTS

| | | |
|---|---|---|
| EP | 406161 A2 | 1/1991 |
| EP | 604177 A2 | 6/1994 |

(Continued)

OTHER PUBLICATIONS

TechBriefs Mold Polishing: moldMAX® & Protherm® www.brushwellman.comooshows SPI-SPE finish number relative to RMS surface roughness measured in microinches.

(Continued)

*Primary Examiner* — Sameh Tawfik
*Assistant Examiner* — Eduardo R Ferrero

(57) ABSTRACT

A package having a roughened surface that does not adhere to a medical device enclosed therein.

7 Claims, 7 Drawing Sheets

(56) References Cited

U.S. PATENT DOCUMENTS

| | | | | |
|---|---|---|---|---|
| 5,084,393 | A | 1/1992 | Rogalsky | |
| 5,130,011 | A | 7/1992 | Sage, Jr. | |
| 5,337,888 | A | 8/1994 | Morrison | |
| 5,375,698 | A | 12/1994 | Ewart | |
| 5,383,550 | A * | 1/1995 | Tsao | 206/5.1 |
| 5,409,104 | A | 4/1995 | Lovell | |
| 5,467,868 | A * | 11/1995 | Abrams et al. | 206/5.1 |
| 5,515,964 | A | 5/1996 | Bauman | |
| 5,524,419 | A | 6/1996 | Shannon | |
| 5,573,108 | A | 11/1996 | Hamilton | |
| 5,609,246 | A | 3/1997 | Borghorst | |
| 5,687,541 | A * | 11/1997 | Martin et al. | 53/54 |
| 5,695,049 | A | 12/1997 | Bauman | |
| 5,697,495 | A | 12/1997 | Abrams | |
| 5,704,468 | A | 1/1998 | Lust | |
| 5,706,634 | A * | 1/1998 | Edwards et al. | 53/473 |
| 5,710,302 | A | 1/1998 | Kunzler | |
| 5,711,416 | A | 1/1998 | Bauman | |
| 5,722,536 | A | 3/1998 | Pierce et al. | |
| 5,760,100 | A | 6/1998 | Nicolson et al. | |
| 5,776,999 | A | 7/1998 | Nicolson et al. | |
| 5,789,461 | A | 8/1998 | Nicolson et al. | |
| 5,823,327 | A | 10/1998 | Wu et al. | |
| 5,849,811 | A | 12/1998 | Nicolson et al. | |
| 5,965,631 | A | 10/1999 | Nicolson et al. | |
| 5,972,292 | A | 10/1999 | DeMeo | |
| 5,983,608 | A | 11/1999 | Wu et al. | |
| 5,998,498 | A | 12/1999 | Vanderlaan et al. | |
| 6,029,808 | A | 2/2000 | Peck et al. | |
| 6,042,230 | A | 3/2000 | Neadle et al. | |
| 6,044,966 | A | 4/2000 | Haase | |
| 6,050,398 | A * | 4/2000 | Wilde et al. | 206/5.1 |
| 6,082,533 | A | 7/2000 | Smith et al. | |
| 6,087,415 | A | 7/2000 | Vanderlaan et al. | |
| 6,244,430 | B1 | 6/2001 | Travis | |
| 6,286,666 | B1 | 9/2001 | Umdasch | |
| 6,318,548 | B1 | 11/2001 | Travis | |
| 6,398,018 | B1 | 6/2002 | Livesley et al. | |
| 6,401,915 | B1 | 6/2002 | Faxe | |
| 6,474,465 | B1 | 11/2002 | Jux | |
| 6,531,432 | B2 | 3/2003 | Molock et al. | |
| 7,086,526 | B2 * | 8/2006 | Newman | 206/5.1 |
| 7,156,641 | B2 | 1/2007 | Ansell et al. | |
| 7,225,919 | B2 | 6/2007 | Hamilton | |
| 7,850,002 | B2 | 12/2010 | Newman | |
| 7,967,133 | B2 | 6/2011 | Newman | |
| 2002/0046958 | A1 | 4/2002 | Lipscomb et al. | |
| 2002/0071789 | A1 | 6/2002 | Molock et al. | |
| 2004/0004008 | A1 | 1/2004 | Peck et al. | |
| 2007/0119720 | A1 | 5/2007 | Marmo | |
| 2008/0230403 | A1 | 9/2008 | Lipscomb et al. | |
| 2008/0257389 | A1 | 10/2008 | Daulton | |
| 2009/0145091 | A1 | 6/2009 | Connolly et al. | |

FOREIGN PATENT DOCUMENTS

| | | |
|---|---|---|
| JP | 38015185 | 8/1963 |
| JP | 2000187188 | 10/1991 |
| JP | 6238682 | 6/1994 |
| JP | 6296514 | 6/1994 |
| JP | 7322911 | 3/1997 |
| JP | 2001524334 | 6/1999 |
| JP | 2000016905 | 1/2000 |
| WO | WO 9421698 A1 | 9/1994 |
| WO | WO 9821995 A1 | 5/1998 |

OTHER PUBLICATIONS

Table of Grit Sizes ExonMobil Chemical, PP1105 Homopolymer for Injection Molding of Medical Devices and Packaging.

* cited by examiner

CONTACT LENS PACKAGES

RELATED APPLICATIONS

This application is a continuation of U.S. patent application Ser. No. 12/897,005, filed on Oct. 4, 2010, which is a continuation application of U.S. patent application Ser. No. 11/937,780, filed on Nov. 9, 2007, now abandoned, which is a continuation application of U.S. patent application Ser. No. 10/458,439, filed on Jun. 10, 2003, now abandoned, which is a continuation-in-part of U.S. patent application Ser. No. 10/183,133, filed on Jul. 26, 2002, now abandoned.

This invention related to packages for storing contact lenses as well as methods of using and preparing these packages.

BACKGROUND

Contact lenses have been used commercially to improve vision since the 1950s. At first contact lenses were made of hard materials, which were relatively easy to handle and package for use, but were uncomfortable for many patients. Later developments, gave rise to softer more comfortable lenses made of hydrophobic hydrogels, particularly silicone hydrogels. These lenses are very pliable, but due to this texture and their chemical composition, they present a number of problems with packaging.

Most contact lenses are packaged in individual blister packages having a bowl portion and a foil top, where the bowl portion is made from a hydrophobic material such as polypropylene. See U.S. Pat. Nos. 4,691,820; 5,054,610; 5,337,888; 5,375,698; 5,409,104; 5,467,868; 5,515,964; 5,609,246; 5,695,049; 5,697,495; 5,704,468; 5,711,416; 5,722,536; 5,573,108; 5,823,327; 5,704,468; 5,983,608; 6,029,808; 6,044,966; and 6,401,915 for examples of such packaging, all of which are hereby incorporated by reference in their entirety. While polypropylene is resilient enough to withstand the sterilization steps of contact lens manufacture, this material has an affinity for contact lenses made of silicone hydrogels. When silicone hydrogels are packaged in polypropylene bowls, the lenses stick to the bowl and cannot be removed from the package without damaging the pliable lenses. Therefore is a need to prepare a contact lens package that has resilient properties, but does not stick to the final product. It is this need that is met by the following invention.

DETAILED DESCRIPTION OF THE INVENTION

Figure 1:
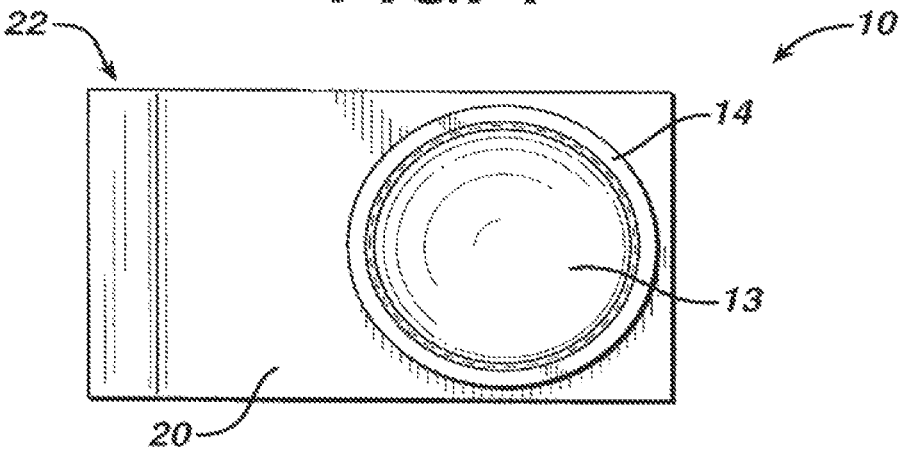
FIG. 1 illustrates the top plan view of a contact lens package.

This invention includes a package for storing medical devices in a solution comprising, consisting essentially of, or consisting of, (a) a molded base comprising
  a cavity formed in said molded base wherein said cavity comprises an inner surface, and
  a flange extending outwardly from the periphery of said cavity wherein said flange comprises a top surface;

(b) a flexible cover sheet superimposed over said top surface of said flange and detachably sealed to said flange at about the periphery of said cavity to form an enclosure between said inner surface and said flexible cover,
  wherein said inner surface has sufficient roughness so that a medical device contained within said enclosure floats freely in a solution.

Further, the invention includes a method of reducing the adherence of a medical device to its package comprising, consisting essentially of, or consisting of, storing said medical device in a solution in a package comprising, consisting essentially of, or consisting of, (a) a molded base comprising
  a cavity formed in said molded base wherein said cavity comprises an inner surface, and
  a flange extending outwardly from the periphery of said cavity wherein said flange comprises a top surface;

(b) a flexible cover sheet superimposed over said top surface of said flange and detachably sealed to said flange at about the periphery of said cavity to form an enclosure between said inner surface and said flexible cover,
  wherein said inner surface has sufficient roughness so that a medical device contained within said enclosure floats freely in a solution.

Still further, the invention includes a package for storing medical devices in a solution comprising, consisting essentially of, or consisting of, (a) a molded base comprising
  a cavity formed in said molded base wherein said cavity comprises an inner surface, and
  a flange extending outwardly from the periphery of said cavity wherein said flange comprises a top surface;

(b) a flexible cover sheet superimposed over said top surface of said flange and detachably sealed to said flange at about the periphery of said cavity to form an enclosure between said inner surface and said flexible cover,
  wherein the surface contact area of said inner surface is about 25 percent to about 75 percents of said inner surface.

Yet, still further, the invention includes a package for storing medical devices in a solution comprising, consisting essentially of, or consisting of, (a) a molded base comprising
  a cavity formed in said molded base wherein said cavity comprises an inner surface, and
  a flange extending outwardly from the periphery of said cavity wherein said flange comprises a top surface;

(b) a flexible cover sheet superimposed over said top surface of said flange and detachably sealed to said flange at about the periphery of said cavity to form an enclosure between said inner surface and said flexible cover, wherein the surface contact area of said inner surface is about 25 percent to about 75 percents of said inner surface, and a medical device contained within said enclosure floats freely in a solution.

Even, yet still further, the invention includes a method of making a molded base comprising a cavity formed in said molded base, wherein said cavity comprises an inner surface, and a flange extending outwardly from the periphery of said cavity wherein said flange comprises a top surface;

wherein said inner surface of said cavity has sufficient roughness so that a medical device contained within said cavity floats freely in a solution wherein the method comprises, consists essentially of, or consists of roughening the mold forming surface of a tool to a sufficient roughness and forming the mold on said surface of a tool.

As used herein a "medical device" is any device that is used to treat a human condition and is packaged in a solution. Examples of medical devices include but are not limited to ophthalmic devices that reside in or on the eye. Ophthalmic devices includes but are not limited to soft contact lenses, intraocular lenses, overlay lenses, ocular inserts, and optical inserts. These devices can provide optical correction or may be cosmetic. The preferred medical devices of the invention are soft contact lenses made from silicone elastomers or hydrogels, which include but are not limited to silicone hydrogels, and fluorohydrogels. Soft contact lens formulations are disclosed in U.S. Pat. No. 5,710,302, WO 9421698, EP 406161, JP 2000016905, U.S. Pat. No. 5,998,498, U.S. patent application Ser. No. 09/532,943, U.S. Pat. Nos. 6,087,415, 5,760,100, 5,776,999, 5,789,461, 5,849,811, and 5,965,631. The foregoing references are hereby incorporated by reference in their entirety. The particularly preferred medical devices of the invention are soft contact lenses made from etafilcon A, genfilcon A, lenefilcon A, polymacon, acquafilcon A, balafilcon A, lotrafilcon A. and silicone hydrogels as prepared in U.S. Pat. No. 5,998,498, U.S. patent application Ser. No. 09/532,943, a continuation-in-part of U.S. patent application Ser. No. 09/532,943, filed on Aug. 30, 2000, U.S. Pat. Nos. 6,087,415, 5,760,100, 5,776,999, 5,789,461, 5,849,811, and 5,965,631. These patents as well as all other patent disclosed in this application are hereby incorporated by reference in their entirety. The most particularly preferred medical devices of the invention are soft contact lenses made acquafilcon A, balafilcon A, or lotrafilcon A.

The term "solution" refers to any liquid medium in which a medical device is stored. The preferred solutions are aqueous solutions contain physiological buffers. The particularly preferred solution is saline solution. The term "cavity" refers to an unfilled space suitable for holding a medical device and a solution. If the medical device is a soft contact lens shape of the cavity can be, but is not limited to the shape of the cavities in U.S. Pat. Nos. 4,691,820; 5,054,610; 5,337,888; 5,375,698; 5,409,104; 5,467,868; 5,515,964; 5,609,246; 5,695,049; 5,697,495; 5,704,468; 5,711,416; 5,722,536; 5,573,108; 5,823,327; 5,704,468; 5,983,608; 6,029,808; 6,044,966; and 6,401,915. The term "inner surface" refers to the surface of the cavity that is adjacent, but not adhering to the medical device.

The term "floats freely" refers to the physical interaction of the medical device with the molded base and the solution. A medical device floats freely in solution when the molded base filled with the device and the solution is rotated or jiggled in a manner where the solution is not spilled and the medical device contained therein, does not adhere to the inner surface of said molded base. For example if the medical device is a contact lens packaged with saline solution, the physical interaction of the contact lens with its packaging may be tested as follows. The flexible cover sheet is removed and the molded base is rotated or jiggled without spilling the saline solution while the contact lens is observed to determine if it is adhered to the inner surface of the molded base.

The term "sufficient roughness" refers to the texture of the inner surface. Functionally, this surface must be rough enough so that a medical device immersed in a solution floats freely in said solution. For example, if the medical device is a contact lens immersed in a packing solution, particularly a silicone hydrogel contact lens, said lens floats freely in the packing solution.

The degree of roughness can be expressed as the average roughness ("Ra," μm) which is measured by a number of machines which include but are not limited to Dimension 3000, manufactured by Digital Instruments, New View 200, manufactured by Zygo Corporation, and Form Talysurf Series Two, manufactured by Taylor Hobson Precision. The choice of machine is determined by the roughness of the surface. For example for surfaces having a surface roughness of ≤1.00 μm the Dimension 3000 may be used. For rougher surfaces, either the New View 200 or the Form Talysurf Series Two, may be used. Preferably, the Ra of the inner surface is about 0.2 μm to about 20. μm, more preferably, about 1.8 μm to about 4.5 μm, even more preferably about 1.9 μm to about 2.1 μm, more preferably still about 0.3 μm to about 0.9 μm, even more preferably about 0.4 μm to about 0.9 μm, even more still, about 0.5 μm to about 0.8 μm, and most preferably about 0.6 μm.

The molded base may be prepared from any number of materials provided that those materials are compatible with the inspection and sterilization requirements of device manufacture. Examples of suitable materials include but are not limited to polypropylene, polyethylene, nylons, olefin co-polymers, acrylics, rubbers, urethanes, polycarbonates, or fluorocarbons. The preferred materials are metallocenes polymers and co-polymers made of polypropylene, polyethylene, having a melt flow range of about 15 g/10 minutes to about 44 g/10 minutes as determined by ASTM D-1238. The molded base is formed by any of a number of methods, which include but are not limited to injection molding, where the surface of the metal tool that is used to form the molded base is roughened by glass bead blasting or electron discharge machining ("EDM") to serve as a template for the roughened inner surface.

The "flexible cover sheet" can be an adhesive laminate of an aluminum foil and a polypropylene film or any other extruded or co-extruded film that can be sealed to the top surface of the flange in order to form a hermetic seal for the medical device and the solution. The flexible cover need not be completely sealed to the entire top surface of the flange and preferably the flexible cover sheet is sealed an area of the flange that is in close proximity to the cavity. Further the flexible cover sheet need not cover the entire top surface of said molded base. As used herein, the term "forming refers to all suitable methods of preparing of preparing the molded base, including but not limited to injection molding and thermal molding. The preferred method of forming the molded base is injection molding.

As used herein the term "surface contact area" refers to the portion of the inner surface that can have physical contact with, but does not adhere to the medical device. Due to fact that the medical device floats freely in the packaging, the inner surface may have areas that are not in contact with the medical device at all times, particularly when the package is rotated. Therefore, the surface contact area is measured as a percentage of total inner surface that can have contact with the medical device, at any time. The preferred surface contact area is about 33 to about 65 percent of the inner surface.

Figure 2:
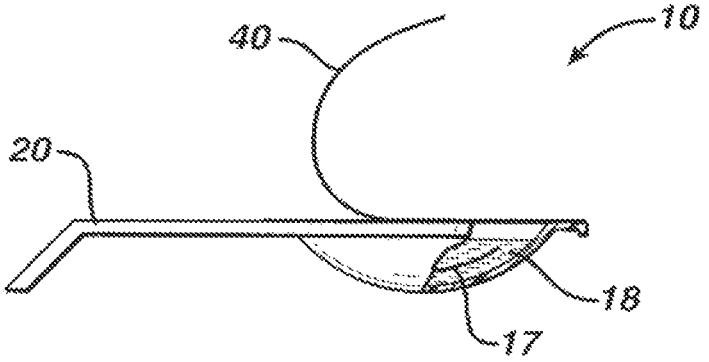
FIG. 2 illustrates the side plan view of a contact lens package

FIG. 1 illustrates the top plan view of one embodiment of the invention, a contact lens package. Molded base 10, having a rectangular flange 22, having a top surface 20 and inner surface 13, is shown. The flexible clover sheet 40 (not shown) is detachably attached to top surface 20 at the raised annular sealing area 14. FIG. 2 illustrates the side plan view the package having cavity 30, flexible cover sheet 40 (shown half pulled back), the packaged contact lens, 17 and solution 18.

Inner surface 13 may be roughed with glass bead blasting, EDM or other treatments. For example in order to produce an inner surface having an Ra of about 1.0 μm to about 2.0 μm, the tools that are used to form the molds are glass bead blasted on the appropriate surface. For example in order to produce an inner surface having an Ra of about 1.0 μM, the tool is blasted at a pressure of about 40 to about 60 psi for about 20 secs. To produce an inner surface having an Ra of about 2.0 μm, the tool is blasted at a pressure of about 60 to about 80 psi for about 20 secs. In order to produce inner surfaces having an Ra 19 μm, a design is etched on the appropriate surface of the the tool using EDM and the same surface is treated glass bead blasted at about 40 to about 60 psi.

Figure 3:
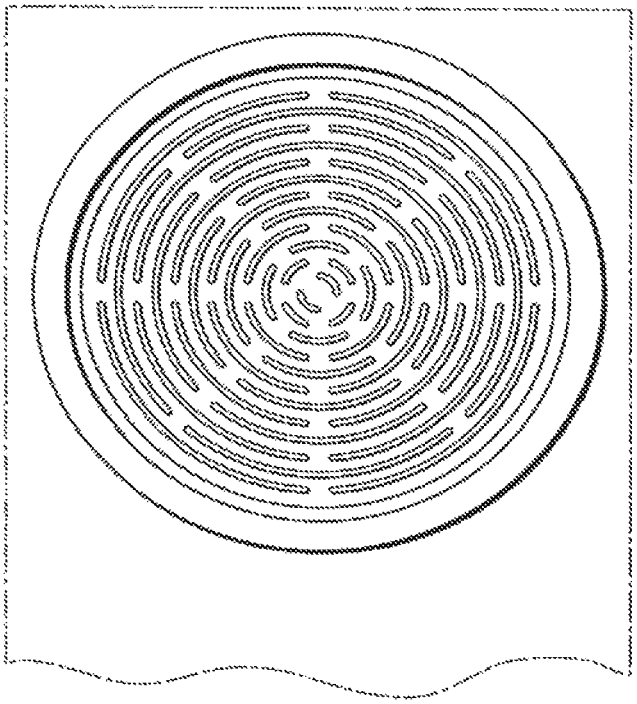
FIG. 3 illustrates the top plan view the maze configuration.
Figure 4:
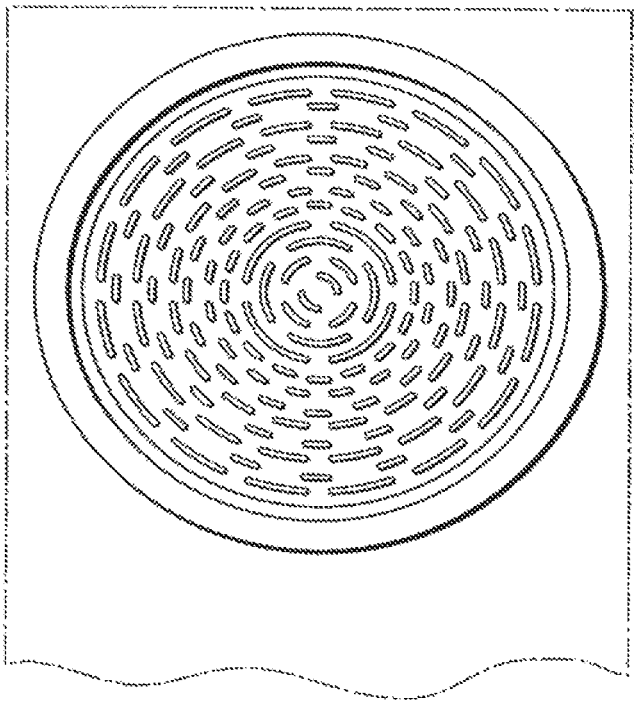
FIG. 4 illustrates the top plan view of radial configuration.
Figure 5:
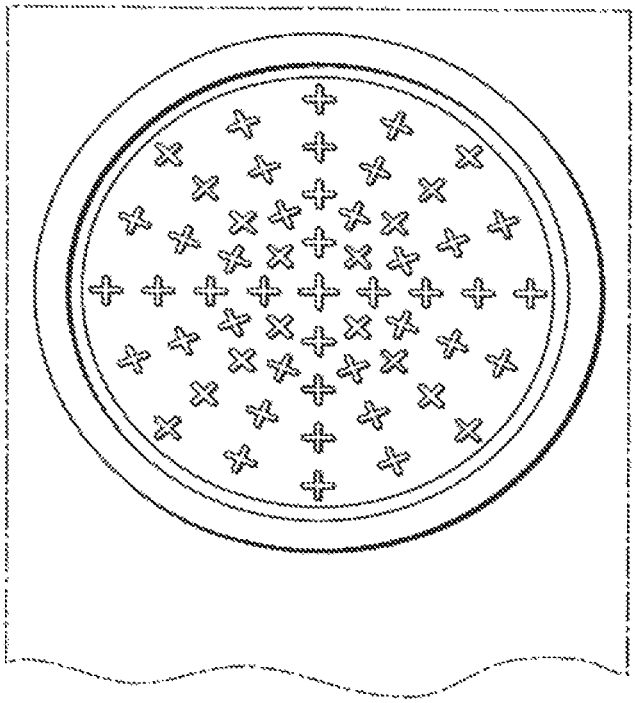
FIG. 5 illustrates the top plan the cross hair design configuration.
Figure 6:
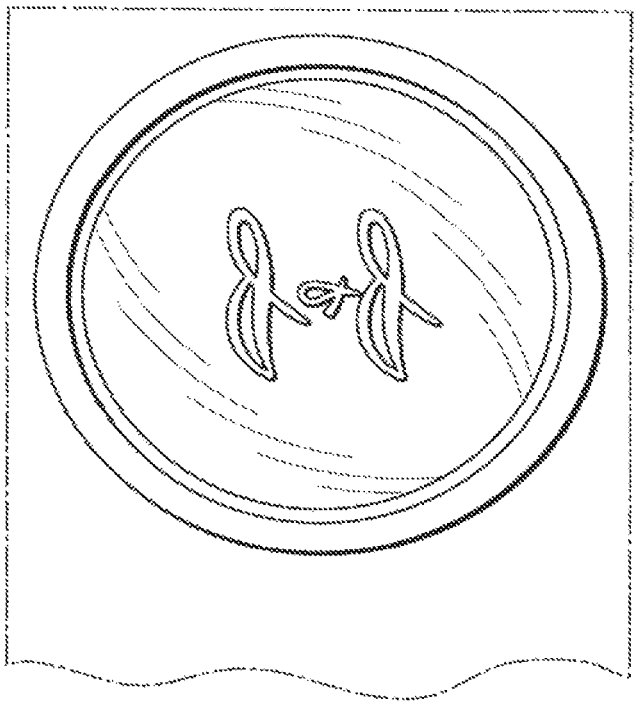
FIG. 6 illustrates the bottom plan view of the logo configuration.
Figure 6A:
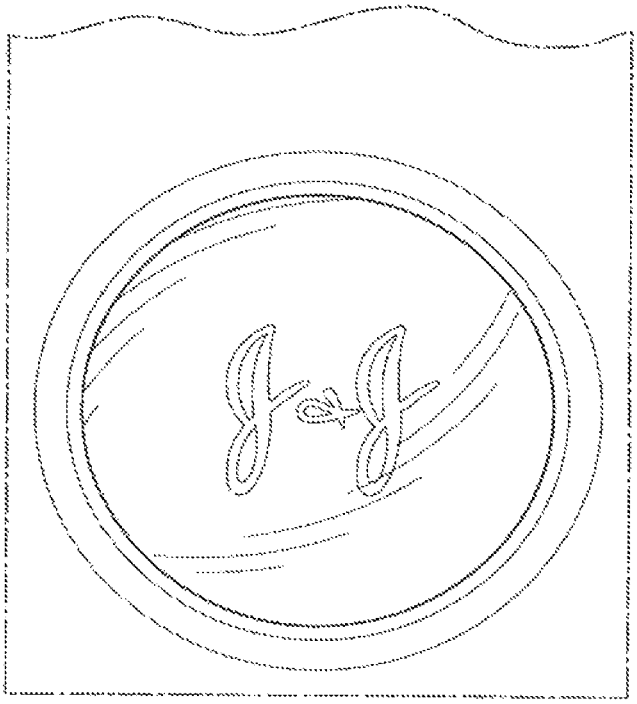
FIG. 6*a* illustrates the top plan view of the logo configuration.
Figure 7:
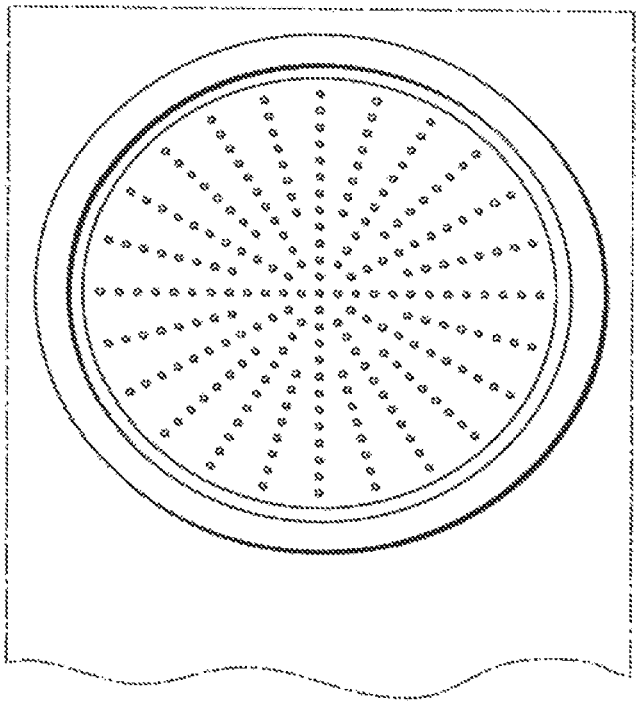
FIG. 7 illustrates the top plan view of the spin wheel configuration.
Figure 8:
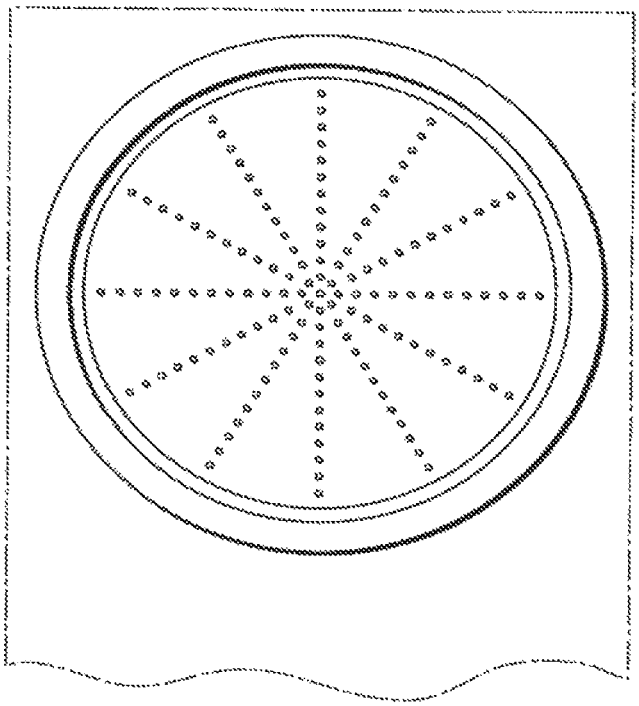
FIG. 8 illustrates the top plan view of the ferris wheel configuration.
Figure 9:
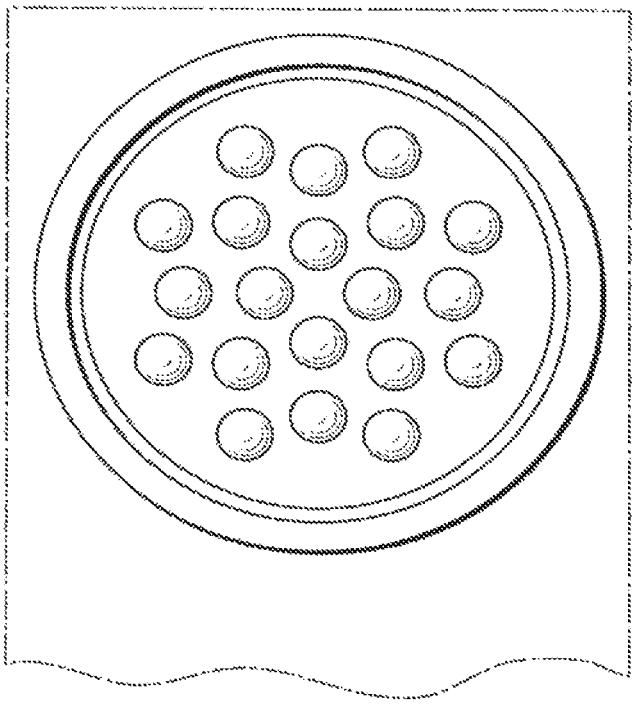
FIG. 9 illustrates the top plan view of the golf ball configuration.
Figure 10:
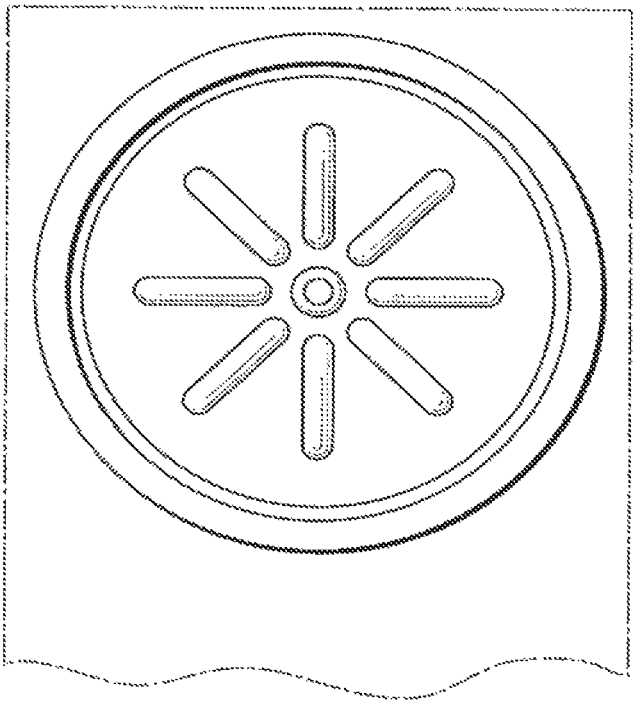
FIG. 10 illustrates the top plan view of the sand dollar configuration.
Figure 11:
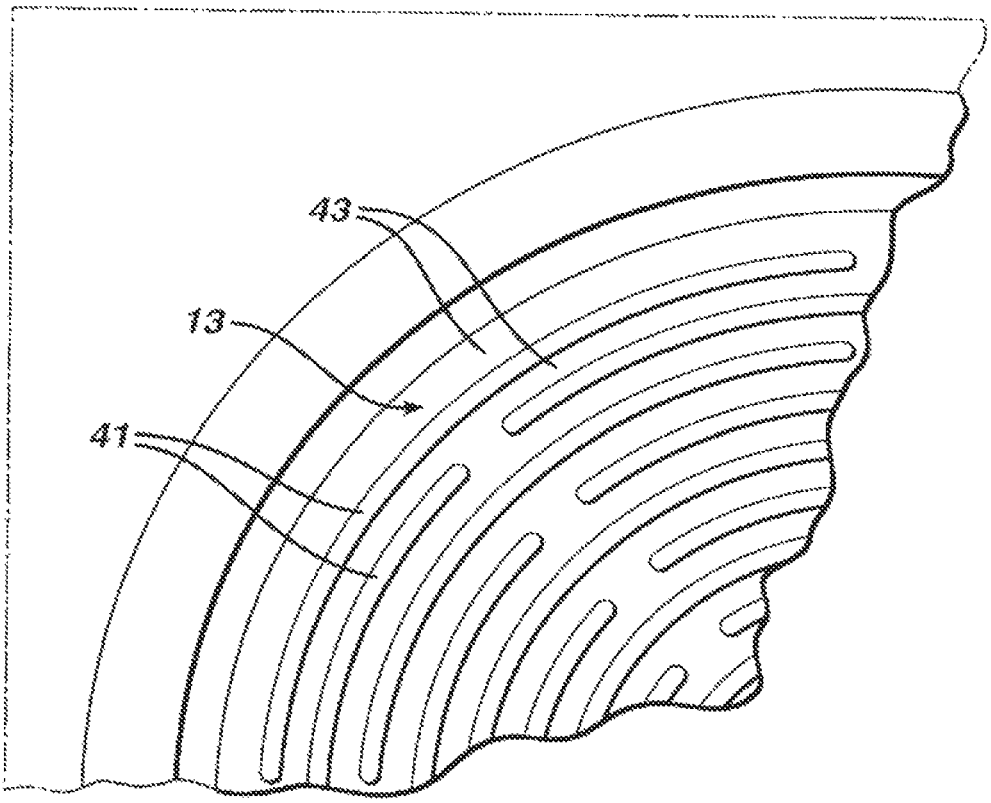
FIG. 11, illustrated the top plan view of an enlarged portion of inner surface of the maze configuration.

In order to produce an inner surface having an surface contact area of about 30 percent to about 70 percent, a design is formed on the tool's appropriate surface using EDM. A number of different designs for inner surface 13 are illustrated in the following figures. FIG. 3 illustrates the top plan view of inner surface 13, in the maze configuration. FIG. 4 illustrates the top plan view of inner surface 13, in the radial configuration. FIG. 5 illustrates the top plan view of inner surface 13, in the cross hair design configuration. FIG. 6 illustrates the bottom plan view of inner surface 13, in the logo configuration. FIG. **6*a* illustrates the top plan view of inner surface 13, in the logo configuration. FIG. 7 illustrates the top plan view of inner surface 13, in the spin wheel configuration. FIG. 8 illustrates the top plan view of inner surface 13, in the ferris wheel configuration. FIG. 9 illustrates the top plan view of inner surface 13, in the golf ball configuration. FIG. 10 illustrates the top plan view of inner surface 13, in the sand dollar configuration. FIG. 11, illustrated the top plan view of an enlarged portion of inner surface 13 of the maze configuration. In this figure representative raised portions 41 and recessed portions 43 are illustrated. The surface contact area of inner surfaces 13** surfaces may be calculated by the measuring the surface area of all raised portions and recessed portions of the inner surface.

When soft contact lenses are prepared the lenses cured to a hard disc and subsequently hydrated with water to give the non-sterilized final product. During this hydration step, soft contact lenses often stick to the surface of the hydration chamber and it would useful to find a method of hydrating soft contact lenses which alleviates this problem.

To solve this problem, the invention includes a method of hydrating a contact lens comprising, consisting essentially of, or consisting of hydrating said lens in a molded base wherein said molded base comprises a cavity formed in said molded base, wherein said cavity comprises an inner surface wherein said inner surface of said cavity has sufficient roughness so that a contact lens contained within said cavity floats freely in a solution.

Further, the invention includes a method of hydrating a contact lens comprising, consisting essentially of, or consisting of hydrating said lens in a molded base wherein said molded base comprises a cavity formed in said molded base, wherein said cavity comprises an inner surface wherein the surface contact area of said inner surface is about 25 percent to about 70 percents of said inner surface.

Still further, the invention includes a molded base comprising, consisting essentially of, or consisting of a cavity formed in said molded base, wherein said cavity comprises an inner surface wherein said inner surface has sufficient roughness so that a medical device contained within said cavity floats freely in a solution.

Yet still further, the invention includes a molded base comprising, consisting essentially of, or consisting of, a cavity formed in said molded base wherein said cavity comprises an inner surface wherein the surface contact area of said inner surface is about 25 percent to about 75 percents of said inner surface.

Even yet still further, the invention includes a method of making a molded base comprising a cavity formed in said molded base, wherein said cavity comprises an inner surface wherein said inner surface has sufficient roughness so that a medical device contained within said cavity floats freely in a solution.

wherein the method comprises, consists essentially of, or consists of roughening the inner surface. As used herein, the term "roughening" refers to methods of changing the texture of the inner surface which include but are not limited to glass bead blasting or EDM treatment.

In order to illustrate the invention the following examples are included. These examples do not limit the invention. They are meant only to suggest a method of practicing the invention. Those knowledgeable in contact lenses as well as other specialties may find other methods of practicing the invention. However, those methods are deemed to be within the scope of this invention.

EXAMPLES

Example 1

Preparation of Packages with Different Inner Surfaces

Nickel plated polished inserts were held in a rotating fixture. The fixture was rotated for a duration of 20 seconds at one revolution per second and sprayed from an angle of 30 degrees at a distance of 89 mm with glass beads (Cyclone Glass Bead, 60-100 G, R3893 medium) from a Cyclone 6.500 mm (diameter) nozzle. To produce a light blast the pressure of the spray is set at 40 psi. To produce a medium blast, the pressure is set at 60 psi. To produce a heavy blast, the pressure is set at 80 psi. These inserts were used to injection mold the base of several different contact lens packages from polypropylene (Exxon Achieve, PP1605, a metallocene polypropylene having a melt flow of 32 g/10 minutes, ASTM D-1238 (L). If the required degree of roughness was not obtained after one roughening procedure, the inserts were roughened again.

Example 2

Preparation of Several Designs

Polished nickel plated inserts were held in a fixture. The desired designs were produced using a CAD software system and exported to a computer system of a laser cutting machine. The insert was attached to a fixture of the laser cutting machine and the inserts were cut using that machine. After EDM treatment some inserts were glass bead blasted as well. These inserts were used to injection mold the base of several different contact lens packages from polypropylene (Exxon Achieve, PP1605, a metallocene polypropylene having a melt flow of 32 g/10 minutes, ASTM D-1238 (L).

Example 3

Testing of Contact Lens Packages

Contact lenses made from acquafilcon A, a silicone hydrogel, were added to individual polypropylene blister packs having different inner surfaces containing 950 μL of saline solution and then the blister pack was heat sealed. Lenses were visually evaluated for lens' adhesion to the package after sterilization. The design of the package, the Ra number (μm), percentage of surface contact area, the number of lenses that stuck to the package, and number of lenses that were free floating is displayed in Table 1.

TABLE 1

| Inner Surface | Ra, μm | percent surface contact area | # lenses tested | # stuck |
|---|---|---|---|---|
| control | 0.139 | 100 | 84 | 84 |
| light blast | 0.549 | N/A | 12 | 4 |
| medium blast | 1.038 | N/A | 60 | 2 |
| heavy blast | 1.912 | N/A | 60 | 0 |
| maze | N/A | 65 | 60 | 0 |
| cross hair | N/A | N/A | 12 | 8 |
| spin wheel | N/A | N/A | 12 | 8 |
| ferris wheel | N/A | 2 | 12 | 12 |
| sand dollar | N/A | 11 | 12 | 11 |
| golf ball | N/A | 16 | 12 | 9 |
| logo design | N/A | N/A | 12 | 12 |
| radial design | N/A | 33 | 60 | 1 |
| maze with medium blast | 19.1 | N/A | 60 | 0 |

TABLE 1-continued

| Inner Surface | Ra, μm | percent surface contact area | # lenses tested | # stuck |
|---|---|---|---|---|
| cross hair with medium blast | N/A | N/A | 60 | 0 |
| ferris wheel with medium blast | N/A | N/A | 80 | 0 |
| logo with medium blast | N/A | N/A | 60 | 2 |

This table illustrates the ability of a roughened inner surface to prevent adherence of the lens to its package. The term "N/A" means not available.

What is claimed is:

1. A method of hydrating a contact lens comprising hydrating said lens in a molded base wherein said molded base comprises a cavity formed in said molded base, wherein said cavity comprises an inner surface wherein said inner surface of said cavity has a lens contact area of about 25 percent to about 75 percent of said inner surface, and said molded base further has a roughness; wherein a contact lens contained within said cavity will not adhere to the surface of the base, but will float freely in a solution.

2. The method of claim 1, wherein the molded base has a roughness of about 1.0 μm to about 20 μm.

3. The method of claim 1 wherein the molded base has a roughness of about 1.8 μm to about 4.5 μm.

4. The method of claim 1 wherein the molded base has a roughness of about 0.4 μm to about 0.9 μm.

5. The method of claim 1 wherein the molded base has a roughness of about 0.5 μm to about 0.8 μm.

6. The method of claim 1 wherein the molded base has a roughness of about 0.6 μm.

7. A method of hydrating a contact lens comprising hydrating said lens in a molded base wherein said molded base comprises a cavity formed in said molded base, wherein said cavity comprises an inner surface wherein the surface contact area of said inner surface is about 25 percent to about 75 percents of said inner surface.

* * * * *